US010988948B2

(12) United States Patent
May et al.

(10) Patent No.: US 10,988,948 B2
(45) Date of Patent: Apr. 27, 2021

(54) TELESCOPIC POLE FOR SUPPORTING A CURTAIN ENCLOSURE

(71) Applicant: TRIMACO, LLC, Morrisville, NC (US)

(72) Inventors: David Cleveland May, Durham, NC (US); Maria Parker Costello, Durham, NC (US); Yichen Wang, Morrisville, NC (US)

(73) Assignee: TRIMACO, LLC, Morrisville, NC (US)

( * ) Notice: Subject to any disclaimer, the term of this patent is extended or adjusted under 35 U.S.C. 154(b) by 232 days.

(21) Appl. No.: 15/025,341

(22) PCT Filed: Sep. 26, 2014

(86) PCT No.: PCT/US2014/057810

§ 371 (c)(1),
(2) Date: Mar. 28, 2016

(87) PCT Pub. No.: WO2015/048513

PCT Pub. Date: Apr. 2, 2015

(65) Prior Publication Data

US 2016/0208503 A1 Jul. 21, 2016

Related U.S. Application Data

(60) Provisional application No. 61/884,028, filed on Sep. 28, 2013.

(51) Int. Cl.

| | |
|---|---|
| ***E04G 21/24*** | (2006.01) |
| ***E04G 25/06*** | (2006.01) |
| *E04G 25/00* | (2006.01) |

(52) U.S. Cl.

CPC ..... *E04G 21/243* (2013.01); *E04G 25/06* (2013.01); *E04G 2025/003* (2013.01); *E04G 2025/006* (2013.01)

(58) Field of Classification Search

CPC . E04G 21/243; E04G 25/06; E04G 2025/006; E04G 21/24; E04G 21/30; E04G 25/08; E04G 2021/248; E04H 12/182

See application file for complete search history.

(56) References Cited

U.S. PATENT DOCUMENTS 5,682,653 A 11/1997 Berglof et al.
5,924,469 A * 7/1999 Whittemore ..... A47H 21/00 160/351

(Continued)

FOREIGN PATENT DOCUMENTS

CN 201507515 6/2010
CN 201780450 3/2011

(Continued)

OTHER PUBLICATIONS

Testrite VCE3 Single Sided Clamp, available Jun. 26, 2013, accessed Oct. 15, 2019 from http://www.testrite.com/browse/specialty-stands/clamp-stands/ (Year: 2013).*

(Continued)

*Primary Examiner* — Katherine W Mitchell
*Assistant Examiner* — Jeremy C Ramsey
(74) *Attorney, Agent, or Firm* — Barnes & Thornburg LLP

(57) ABSTRACT

A support pole that includes a telescopic rod including a first shaft configured to move relative to a second shaft, first pad secured to a first end of the first shaft, a retention mechanism secured to the first shaft between the end of the first shaft and the second shaft, and a second pad secured to the second shaft. The retention mechanism is operable to move between an engaged position in which a sheet or curtain may be secured to the telescopic rod and a disengaged position in which the sheet is detached from the telescopic rod.

7 Claims, 5 Drawing Sheets

(56) References Cited

U.S. PATENT DOCUMENTS

| | | | | |
|---|---|---|---|---|
| 6,321,823 | B1 | 11/2001 | Whittemore | |
| 8,074,700 | B1 * | 12/2011 | Melino | E04G 21/30 160/327 |
| 2005/0077015 | A1 * | 4/2005 | Melino, Jr. | E04G 21/30 160/135 |
| 2010/0301000 | A1 | 12/2010 | Whittemore | |
| 2012/0060332 | A1 * | 3/2012 | Mitchell | F16B 45/02 24/592.1 |
| 2013/0008620 | A1 * | 1/2013 | Cusick | E04G 21/30 160/372 |

FOREIGN PATENT DOCUMENTS

| | | | | |
|---|---|---|---|---|
| CN | 202483048 | | 10/2012 | |
| DE | 3219975 | A1 * | 12/1983 | A47K 10/10 |

OTHER PUBLICATIONS

PCT Search Report and Written Opinion for PCT/US2014/057810, completed Dec. 9, 2014.

International Search Report issued in connection with International Application No. PCT/US2014/057810, dated Dec. 9, 2014, 2 pages.

Chinese Search Report for Chinese Application No. 201480002998.7, dated Apr. 17, 2017, 3 pages (Relevance Outlined in Chinese Search Report cited herewith).

* cited by examiner

TELESCOPIC POLE FOR SUPPORTING A CURTAIN ENCLOSURE

CROSS-REFERENCE TO RELATED APPLICATIONS

This application is the U.S. national phase of PCT/US2014/057810, filed on Sep. 26, 2014. PCT/US2014/057810 claims the benefit, under 35 U.S.C. § 119(e), to U.S. Provisional Application No. 61/884,028, filed Sep. 28, 2013. the contents of both of which are incorporated by reference in their entirety into the present application.

BACKGROUND

The present disclosure relates to support poles and, more specifically, to a design for a telescopic pole.

TECHNICAL FIELD

Painters, carpenters, and other individuals working indoors have utilized curtains to enclose a work area to prevent the transmission of dust, odor, or debris into areas outside of the work area. These curtains are typically sheets of plastic or plastic tarps. The curtains are sometimes supported by one or more poles. Such poles may extend between the floor and the ceiling of a room.

SUMMARY

According to one aspect, an apparatus is disclosed. The apparatus includes a sheet, a telescopic rod including a first shaft configured to move relative to a second shaft, a first pad secured to an end of the first shaft, a retention mechanism secured to the first shaft between the end of the first shaft and the second shaft, and a second pad secured to the second shaft. The retention mechanism is operable to move between an engaged position in which the sheet is secured to the telescopic rod and a disengaged position in which the sheet is detached from the telescopic rod.

In some embodiments, the retention mechanism may include a fastener configured to maintain the retention mechanism in the engaged position.

In some embodiments, the fastener includes a pair of magnets.

In some embodiments, the retention mechanism may include a clip having a first arm that is moveable relative to a second arm. When the retention mechanism is in the engaged position, a tip of the first arm may be engaged with the second arm, and when the retention mechanism is in the disengaged position, the tip of the first arm may be spaced apart from the second arm.

According to another aspect, a support pole for a sheet is disclosed. The pole includes a telescopic rod including a first shaft configured to move relative to a second shaft, a first pad secured to an end of the first shaft, a retention mechanism secured to the first shaft between the end of the first shaft and the second shaft, and a second pad secured to the second shaft. The retention mechanism is operable to move between an engaged position in which the sheet is secured to the telescopic rod, and a disengaged position in which the sheet is detached from the telescopic rod.

BRIEF DESCRIPTION OF THE DRAWINGS

The detailed description particularly refers to the following figures, in which.

DETAILED DESCRIPTION OF THE DRAWINGS

Figure 1:
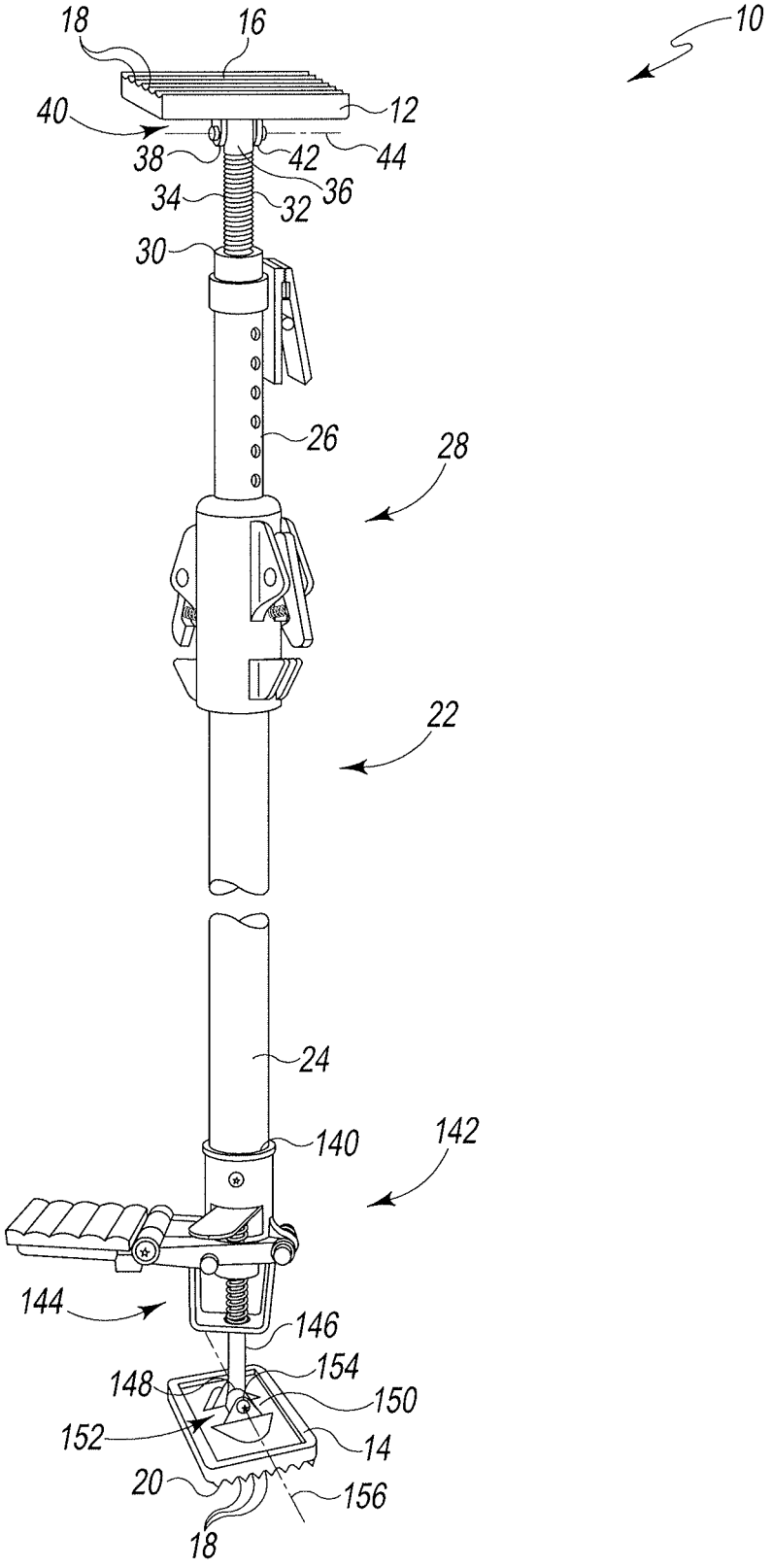
FIG. 1 is a perspective view of a telescopic support pole.

While the concepts of the present disclosure are susceptible to various modifications and alternative forms, specific exemplary embodiments thereof have been illustrated by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the invention as defined by the appended claims.

Referring now to FIG. 1, a telescopic support pole 10 is shown. The pole 10 includes an upper pad 12 configured to engage an upper wall or a ceiling surface of a room and a lower pad 14 configured to engage another wall or a floor surface of the room. In that way, the upper pad 12 may function as a "head pad" of the pole 10, while the lower pad 14 may function as a "foot pad" of the pole 10. It should be appreciated that the pole 10 may be oriented such that the upper pad 12 is engaged with a lower wall or a floor surface and the lower pad 14 is engaged with an upper wall or a ceiling surface.

The pads 12, 14 are formed from elastomeric materials such as, for example, rubber, which is configured to deform when engaged with a surface. The pad 12 also includes an upper surface 16 having a number of grooves 18 defined therein. In the illustrative embodiment, the grooves 18 are configured to grip the surface engaged by the pad 12. Similarly, the lower pad 14 also includes a lower surface 20, which has a number of grooves 18 that are configured to grip the surface engaged by the pad 14.

The support pole 10 also includes a telescopic rod 22 that is positioned between the pads 12, 14. As shown in FIG. 1, the rod 22 includes an outer shaft 24 and an inner shaft 26 that telescopes into and out of the outer shaft 24. The movement of the inner shaft 26 relative to the outer shaft 24 changes the overall length of the support pole 10, making the pole 10 longer when the inner shaft 26 telescopes further out of the outer shaft 24 and shorter when the inner shaft 26 moves further into the outer shaft 24. As described in greater detail below, the support pole 10 includes a locking mechanism 28 that is operable to lock the inner shaft 26 in any of a number of positions relative to the outer shaft 24. In that way, the telescopic rod 22 has a fixed number of predefined lengths.

In the illustrative embodiment, each of the shafts 24, 26 is formed from aluminum. In other embodiments, one or both of the shafts 24, 26 may be formed from stainless steel or another metallic material. It should also be appreciated that one or both of the shafts 24, 26 may be formed from a hard plastic material or fiberglass. Additionally, in other embodiments, portions of one or both shafts 24, 26 may be coated with a grip formed from rubber or another elastomeric material.

As shown in FIG. 1, the inner shaft 26 extends outwardly from the outer shaft 24 to an upper end 30. The upper pad 12 of the pole 10 is secured to the upper end 30 via an upper adjustment mechanism 32. In the illustrative embodiment, the adjustment mechanism 32 includes an externally-threaded rod 34 that is received an internally-threaded bore (not shown) defined in the upper end 30 of the shaft 26. The externally-thread rod 34, like the shafts 24, 26, is formed from a metallic material such as, for example, stainless steel. It should also be appreciated that the rod 34 may be formed from a hard plastic material.

The threaded rod 34 of the adjustment mechanism 32 also has a top end 36 that is attached to the pad 12. In the illustrative embodiment, a bracket 38 extends from the upper pad 12, and the bracket 38 is attached to the rod end 36 via a joint 40. The joint 40 includes a fastener 42 such as, for example, a cylindrical bolt, which extends through bores defined in the end 36 of the rod 34 and the bracket 38. The fastener 42 defines a pivot axis 44 about which the pad 12 may rotate relative to the threaded rod 34. In that way, the upper pad 12 may be tilted to engage angled surfaces such as cathedral ceilings as well as surfaces that are parallel to the floor.

The threaded engagement between the rod 34 and the shaft 26 permits the rod 34 to rotate and move the upper pad 12 relative to the shaft 26. When the rod 34 rotated in a clockwise direction, the upper pad 12 is moved away from the inner shaft 26, thereby increasing the length of the pole 10; when the rod 34 is rotated in the opposite direction, the pad 12 is advanced toward the inner shaft 26, thereby decreasing the length of the pole 10.

It should be appreciated that in other embodiments the adjustment mechanism may be a mechanical actuator such as, for example, ratchet mechanism. The adjustment mechanism may also include a spring or other biasing element to bias the upper pad 12 away from the shaft 26. Additionally, in other embodiments, the adjustment mechanism may be omitted from the support pole 10.

Figure 2:
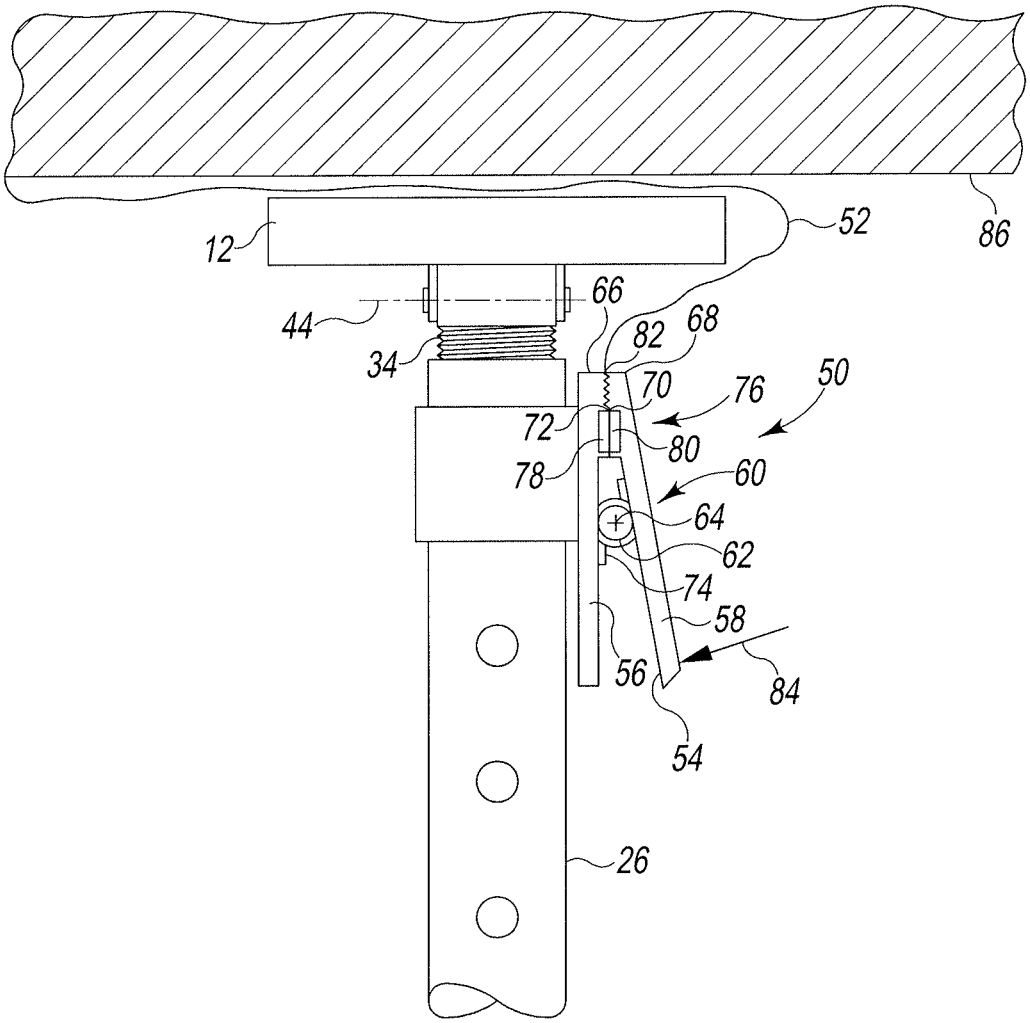
FIG. 2 is an elevation view of an upper portion of the telescopic support pole of FIG. 1 positioned adjacent to a room ceiling.

As shown in FIG. 2, the pole 10 also includes a retention device 50 configured to secure a curtain 52 such as, for example, a plastic sheet, to the pole 10. In the illustrative embodiment, the retention device 50 includes a clip 54 secured to the upper end 30 of the inner shaft 26. The clip 54 includes an arm 56 that is secured to the inner shaft 26 and a pivot arm 58 that is attached to the arm 56 via a joint 60. The joint 60 includes a cylindrical pin 62 that extends through bores defined in the arms 56, 58.

Figure 3:
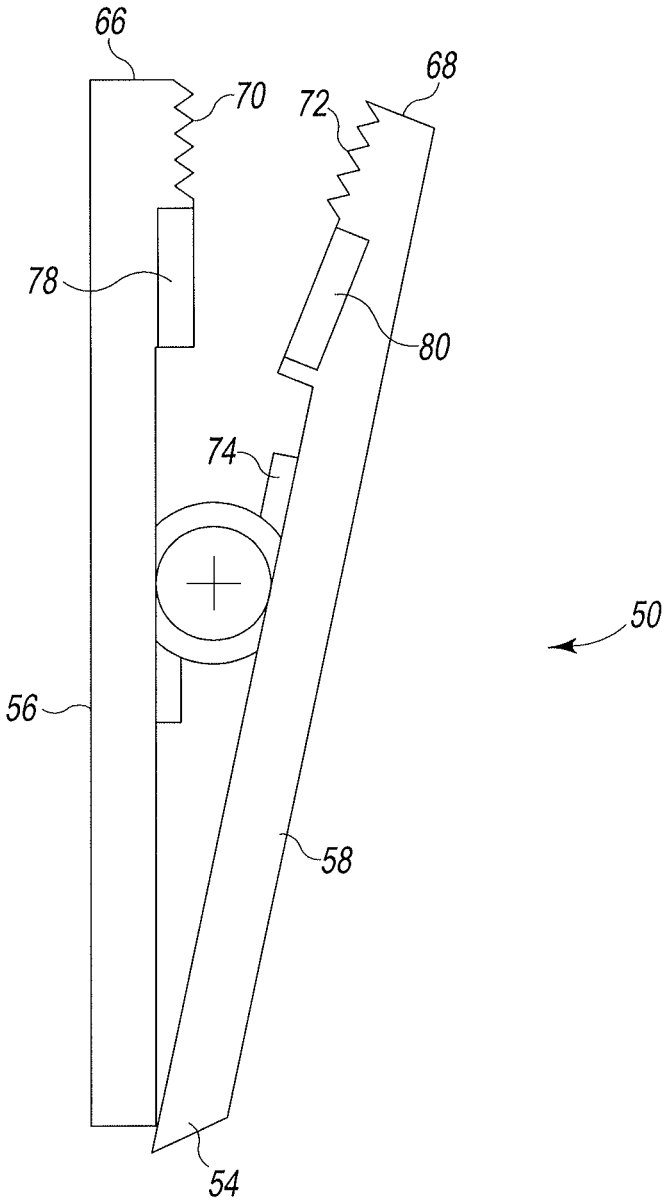
FIG. 3 is an elevation view a retaining clip of the telescopic support pole of FIG. 1.

The pin 62 defines a pivot axis 64 about which the pivot arm 58 may rotate relative to the arm 56. As shown in FIGS. 2-3, the pivot arm 58 may be rotated from a closed position (see FIG. 2) in which the tips 66, 68 of the arms 56, 58 are engaged to an open position (see FIG. 3) in which the tips 66, 68 are spaced apart.

The tips 66, 68 of the arms 56, 58 are configured to grip the curtain 52 to secure the curtain 52 to the pole 10. In the illustrative embodiment, the tips 66, 68 include teeth 70, 72, respectively, that are interdigitated when the pivot arm 58 is in the closed position, and thereby grip the curtain 52. In other embodiments, the tips 66, 68 may include one or more pins, pegs, adhesives, or other fastening means to grip and/or fasten the curtain 52 to the pole 10.

In the illustrative embodiment, the clip 54 also includes a biasing element, such as, for example, a spring 74 configured to bias the arm 58 in the closed position. As shown in FIGS. 2-3, the spring 74 is a metallic torsion spring. It should be appreciated that in other embodiments the biasing element may be a metallic compression spring or other biasing element formed from plastic or an elastomeric material.

Additionally, the clip 54 includes a fastener 76 configured to maintain the arm 58 in the closed position. The fastener 76 is illustratively embodied as a pair of magnets 78, 80 that are attached to the arms 56, 58, respectively, which maintain the arm 58 in the closed position via electromagnetic force. It should be appreciated that in other embodiments the fastener 76 may be a pin or peg and slot arrangement or other fastening means to keep the arm 58 in the closed position.

As described above, a user may operate the adjustment mechanism 32 to move the upper pad 12 toward or away from the inner shaft 26 of the pole 10. As shown in FIG. 2, the curtain 52 may be passed over the upper pad 12 of the support pole 10 such that an edge 82 of the curtain 52 is positioned adjacent to the clip 54. A user may apply force to the pivot arm 58 of the clip 54 in the direction indicated by arrow 84 to overcome the bias exerted by the spring 74 and the electromagnetic force exerted by the magnets 78, 80. When sufficient force is applied, the arm 58 is rotated about the axis 64 from the closed position shown in FIG. 2 to the open position shown in FIG. 3. When the clip 54 is opened, the user may position the edge 82 of the curtain 52 between the tips 66, 68 of the arms 56, 58 before releasing the arm 58.

When the arm 58 is released, the spring 74 urges the tip 68 of the arm 58 toward the tip 66 of the arm 56 to engage the teeth 70, 72 of the arms 56, 58 with the curtain 52. When the arm 58 is in the closed position, the magnets 78, 80 maintain the arm 58 in that position, and the curtain 52 is gripped between the teeth 70, 72. The user may then operate the locking mechanism 28 of the support pole 10, which is described in greater detail below, to release the inner shaft 26 for movement relative to the outer shaft 24. In that way, the upper pad 12 may be advanced into engagement with a surface, such as, for example, a ceiling 86 of a room such that the curtain 52 is gripped between the pad 12 and the ceiling 86.

Figure 4:
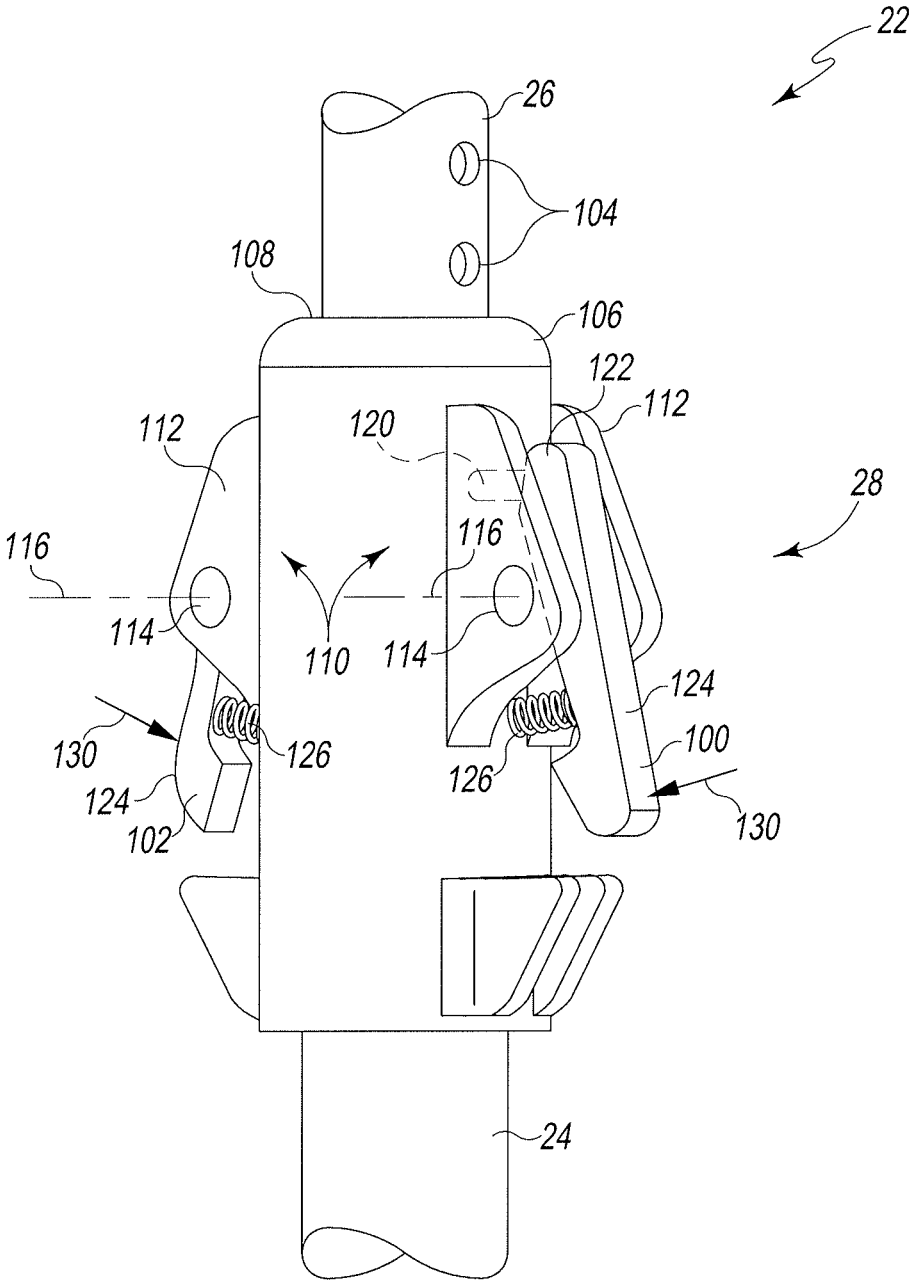
FIG. 4 is a perspective view of a locking mechanism of the telescopic support pole of FIG. 1.

Referring now to FIG. 4, the locking mechanism 28 of the support pole 10 is shown in greater detail. In the illustrative embodiment, the locking mechanism 28 includes a pair of levers 100, 102 attached to the outer shaft 24, which engage any of a number of holes 104 defined in each side of the inner shaft 26, to secure the inner shaft 26 in any of a number of predetermined or predefined positions relative to the outer shaft 24. As shown in FIG. 4, the locking mechanism 28 includes a collar 106 attached to an upper end 108 of the outer shaft 24. Each of the levers 100, 102 is coupled to the collar 106 via a joint 110.

A pair of brackets 112 is positioned on polar opposite sides of the collar 106, and each bracket 112 receives one of the levers 100, 102. The joint 110 includes a cylindrical pin 114 that extends through bores (not shown) defined in the levers 100, 102 and the brackets 112, thereby securing the levers 100, 102 to the brackets 112. The pin 114 defines a pivot axis 116 about which each of the levers 100, 102 may be rotated relative to the collar 106.

Each of the levers 100, 102 includes a locking pin 120 configured to be received in one of the holes 104 defined in the inner shaft 26. In the illustrative embodiment, each pin 120 extends from a tip 122 of the lever, through openings (not shown) defined in the collar 106, and into one of the holes 104 of the inner shaft 26. When the levers 100, 102 are pivoted about their respective axes 116, the pins 120 are moved out of engagement with the holes 104 of inner shaft 26 such that the inner shaft 26 may be moved relative to the outer shaft 24.

As described above, the holes 104 defined in the inner shaft 26 correspond to predetermined lengths of the telescopic rod 22. When the inner shaft 26 has reached a position relative to the outer shaft 24 that corresponds to one of the predetermined lengths of the rod 22, the user may release the levers 100, 102. The springs 126 urge the levers 100, 102 to pivot about the axes 116 and move the locking pins 120 into engagement with the holes 104 corresponding to the desired predetermined length of the rod 22.

As shown in FIG. 4, each of the levers 100, 102 includes an outer end 124 positioned opposite the tip 122. A biasing element 126 is positioned between the outer end 124 of each of the levers 100, 102 and is configured to bias each pin 120 into engagement with its corresponding hole 104 of the inner shaft 26. As shown in FIG. 4, the biasing element 126 is embodied as a metallic compression spring. It should be appreciated that in other embodiments the biasing element may be a metallic torsion spring or other biasing element formed from plastic or an elastomeric material.

In the illustrative embodiment, the collar 106 and the brackets 112 are formed from a hard plastic material, while the springs 126, levers 100, 102, and the pin 114 are formed from a metallic material such as stainless steel. It should be appreciated that in other embodiments the components of the locking mechanism 28 may be formed completely from metal or plastic.

In use, a user applies force to the outer ends 124 of the levers 100, 102 in the direction indicated by arrows 130. When sufficient force is applied, the bias exerted by springs 126 is overcome, and the levers 100, 102 are rotated about the axes 116. As the levers 100, 102 are rotated, the locking pins 120 are moved out of engagement with their corresponding holes 104. When the pins 120 are spaced apart from the holes 104, the inner shaft 26 may be moved relative to the outer shaft 24 to increase or decrease the length of the rod 22.

As described above, the support pole 10 includes a lower pad 14 that is positioned at the opposite longitudinal end the pole 10 from the upper pad 12. Returning to FIG. 1, the outer shaft 24 extends from the upper end 108 to a lower end 140. The lower pad 14 is secured to the lower end 140 of the shaft 24 via a lower adjustment mechanism 142. In the illustrative embodiment, the mechanism 142 includes a mechanical actuator 144 operable to move the lower pad 14 relative to the lower end 140 of the outer shaft 24. It should be appreciated that in other embodiments the mechanism 142 may be similar to the upper adjustment mechanism 32 described above.

As shown in FIG. 1, the actuator 144 includes a piston 146 that extends from an upper end (not shown) received in the lower end 140 of the outer shaft 24 to bottom end 148. In the illustrative embodiment, the piston 146 is cylindrical and, like the shafts 24, 26, is formed from a metallic material such as, for example, stainless steel. It should also be appreciated that the piston 146 may be formed from a hard plastic material. The bottom end 148 of the piston 146 is attached to the lower pad 14.

In the illustrative embodiment, a bracket 150 extends from the lower pad 14, and the bracket 150 is attached to the bottom end 148 of the piston 146 via a joint 152. The joint 152 includes a fastener 154 such as, for example, a cylindrical bolt, which extends through bores defined in the end 148 of the piston 146 and the bracket 150. The fastener 154 defines a pivot axis 156 about which the pad 14 may rotate relative to the piston 146. In that way, the lower pad 14, like the upper pad 12, may be tilted to engage angled surfaces as well as surfaces that are parallel to the ceiling or floor.

Figure 5:
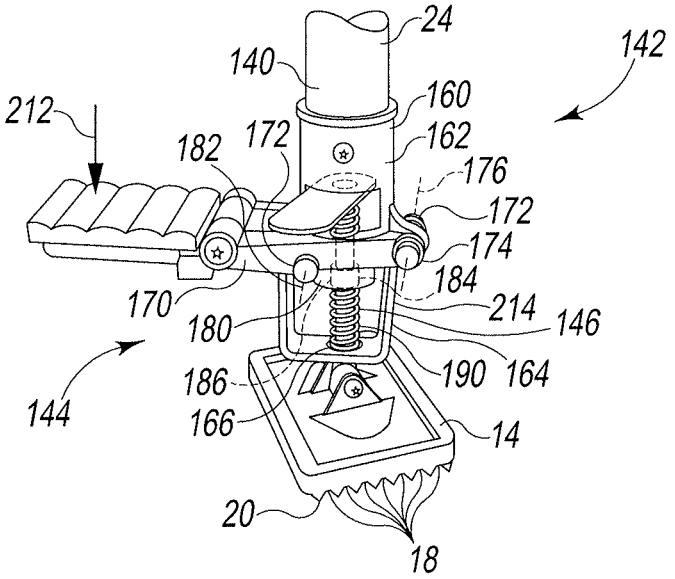
FIGS. 5-6 are perspective views of a lower portion of the telescopic support pole of FIG. 1.
Figure 6:
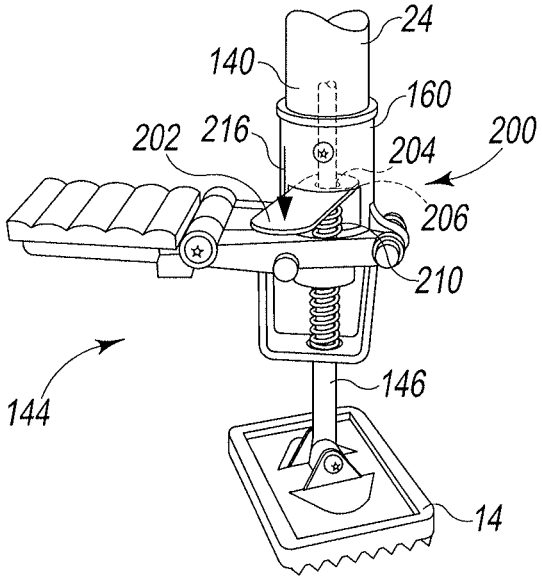

Referring now to FIGS. 5-6, the mechanical actuator 144 includes a collar 160 that is secured to the lower end 140 of the outer shaft 24. The collar 160 includes a cylindrical upper body 162 that is positioned over the shaft end 140 and a support frame 164 that extends downwardly from the upper body 162. As shown in FIGS. 5-6, the piston 146 extends through openings 166 defined in the upper body 162 and the frame 164 of the collar 160. In the illustrative embodiment, each of the components of the actuator 144 is formed from a metallic material such as, for example, stainless steel. It should be appreciated that in other embodiments one or more the components may be formed from a hard plastic material.

The actuator 144 includes a lever arm 170 that is coupled to the support frame 164 via a pivot joint 172. As shown in FIG. 5, the joint 172 includes a pin 174 that extends through bores defined in the frame 164 and the lever arm 170. The pin 174 defines an axis 176 about which the lever arm 170 may be pivoted relative to the frame 164, as described in greater detail below. A ratchet plate 180 is pivotally coupled to the lever arm 170 at another joint 172, which defines an axis 182 about which the lever arm 170 and the plate 180 may be pivoted relative to each other.

The piston 146 extends through an opening 184 defined in the ratchet plate 180. As shown in FIG. 5, the opening 184 is defined by a side wall 186 of the plate 180. In the illustrative embodiment, the side wall 186 is brought into and out of engagement with the piston 146 by the rotation of the lever arm 170 between the raised position shown in FIG. 5 and a lowered position, as described in greater detail below. The actuator 144 also includes a biasing element 190 that is positioned between the lever arm 170 and the support frame 164. The biasing element 190 is illustratively embodied as a metallic compression spring that is configured to bias the lever arm 170 in the raised position shown in FIGS. 5-6.

The actuator 144 also includes a locking device 200 that is configured to lock the piston 146 in position relative to the collar 160. In the illustrative embodiment, the locking device 200 includes a latch lever 202 that is pivotally coupled the upper body 162 of the collar 160, as shown in FIG. 6. The piston 146 extends through an opening 204 defined in the latch lever 202. As shown in FIG. 6, the opening 204 is defined by a side wall 206 of the lever 202, which engages the piston 146 when the lever 202 is in the raised position shown in FIG. 6. The actuator 144 also includes a biasing element 210 that is positioned between the latch lever 202 and the upper body 162. The biasing element 210 is illustratively embodied as a metallic compression spring that is configured to bias the latch lever 202 in the raised position shown in FIG. 6.

To move the lower pad 14 away from the outer shaft 24 of the telescopic rod 22, a user may depress the lever arm 170 in the direction indicated by arrow 212 in FIG. 5. When the bias exerted by spring 146 is overcome, the lever arm 170 is rotated about the axis 176 from the raised position. As the lever arm 170 is rotated about the axis 176, the movement of the lever arm 170 causes the ratchet plate 180 to rotate about the axis 182 and advance the side wall 186 of the plate 180 into engagement with the piston 146. When the side wall 186 is engaged with the piston 146, continued rotation of the lever arm 170 causes the piston 146 to be moved downward, thereby advancing the lower pad 14 away from the outer shaft 24 and increasing the length of the pole 10.

The rotation of the lever arm 170 is limited by a shoulder 214 of the support frame 164. When the lever arm 170 is advanced into engagement with the shoulder 214, the user may release the lever arm 170. The spring 190 urges the lever arm 170 upward such that the ratchet plate 180 is moved out of contact with the piston 146. Because the latch lever 202 is engaged with the piston 146, the piston 146 is locked in position relative to the outer shaft 24.

To move the lower pad 14 toward the outer shaft 24 (and thus decrease the length of the pole 10), a user may apply a force to the latch lever 202 in the direction indicated by arrow 216 in FIG. 6. When sufficient force is applied, the bias exerted by the spring 210 is overcome, and the latch lever 202 is pivoted relative to the piston 146. As described above, the latch lever 202 is biased into engagement with the piston 146. As the latch lever 202 is pivoted, the side wall 206 is disengaged from the piston 146, thereby releasing the piston 146 for movement relative to the shaft 24 and permitting the user to slide the lower pad 14 toward the outer shaft 24.

When the pole 10 has reached a desired length, the user may release the latch lever 202. The biasing element 210 urges the lever 202 back into engagement with the piston 146, thereby locking the piston 146 in position relative to the outer shaft 24.

It will be appreciated that the devices and methods described herein have broad applications. The foregoing embodiments were chosen and described in order to illustrate principles of the methods and apparatuses as well as some practical applications. The preceding description enables others skilled in the art to utilize methods and apparatuses in various embodiments and with various modifications as are suited to the particular use contemplated. In accordance with the provisions of the patent statutes, the principles and modes of operation of this disclosure have been explained and illustrated in exemplary embodiments.

It is intended that the scope of the present methods and apparatuses be defined by the following claims. However, it must be understood that this disclosure may be practiced otherwise than is specifically explained and illustrated without departing from its spirit or scope. It should be understood by those skilled in the art that various alternatives to the embodiments described herein may be employed in practicing the claims without departing from the spirit and scope as defined in the following claims.

What is claimed is:

1. An apparatus comprising:

a sheet, a telescopic rod including a first shaft configured to move relative to a second shaft, a threaded inner shaft extending from a first end of the first shaft, the threaded inner shaft having a diameter smaller than a diameter of the first shaft, a first pad configured to engage the sheet and secured to an end of the threaded inner shaft that is spaced apart from the first end of the first shaft such that a first distance is defined between the first end of the first shaft and the first pad, a retention mechanism secured to the first shaft between the first end of the first shaft and the second shaft such that a second distance is defined between the first pad and the retention mechanism, and a second pad secured to the second shaft, wherein the threaded inner shaft is rotatable relative to the first shaft to change the first distance defined between the first end of the first shaft and the first pad and to change the second distance defined between the first pad and the retention mechanism, wherein the retention mechanism includes a clip having a first pivot arm that is moveable relative to a second fixed arm, wherein (i) the first pivot arm has a first tip spaced apart from the first shaft, and (ii) the second fixed arm has a second tip spaced apart from the first shaft, wherein the second fixed arm is fixed to an outer surface of the first shaft and positioned between the first pivot arm and the first shaft, and the first tip and the second tip point upwardly toward the first pad and engage an end of the sheet that extends downwardly from the first pad, and wherein the retention mechanism is operable to move between (i) an engaged position in which the sheet is gripped between the first tip of the first pivot arm and second tip of the second fixed arm such that the sheet is secured to the telescopic rod, and (ii) a disengaged position in which the first tip is positioned away from the second tip and the sheet is detached from the telescopic rod.

2. The apparatus of claim 1, wherein the retention mechanism includes a fastener configured to maintain the retention mechanism in the engaged position.

3. The apparatus of claim 2, wherein the fastener includes a pair of magnets.

4. A support pole for a sheet comprising:

a telescopic rod including a first shaft configured to move relative to a second shaft, a threaded inner shaft extending from a first end of the first shaft, the threaded inner shaft having a diameter smaller than a diameter of the first shaft, a first pad configured to engage the sheet and secured to an end of the threaded inner shaft that is spaced apart from the first end of the first shaft such that a first distance is defined between the first end of the first shaft and the first pad, a retention mechanism secured to the first shaft between the first end of the first shaft and the second shaft such that a second distance is defined between the first pad and the retention mechanism, and a second pad secured to the second shaft, wherein the threaded inner shaft is rotatable relative to the first shaft to change the first distance defined between the first end of the first shaft and the first pad and to change the second distance defined between the first pad and the retention mechanism, wherein the retention mechanism includes a clip having a first arm that is moveable relative to a second arm, wherein (i) the first arm has a first tip spaced apart from the first shaft, and (ii) the second arm has a second tip spaced apart from the first shaft, wherein the second arm is fixed to the first shaft and positioned between the first arm and the first shaft and the first tip and the second tip point upwardly toward the first pad and engage an end of the sheet that extends downwardly from the first pad, and wherein the retention mechanism is operable to move between (i) an engaged position in which the sheet is gripped between the first tip of the first arm and second tip of the second arm such that the sheet is secured to the telescopic rod, and (ii) a disengaged position in which the first tip is positioned away from the second tip and the sheet is detached from the telescopic rod.

5. The support pole of claim 4, wherein the retention mechanism further includes pin with a center defining the pivot axis and a torsion spring coupled to the pin and configured to bias the first tip and the second tip toward the engaged position.

6. The support pole of claim 5, wherein the retention mechanism further includes a pair of magnets arranged between the first and second tips and the pivot axis.

7. A support pole for a sheet comprising:

a telescopic rod including a first shaft configured to move relative to a second shaft, a threaded inner shaft extending from a first end of the first shaft, the threaded inner shaft having a diameter smaller than a diameter of the first shaft and being rotatable relative to the first shaft, a pad secured to an end of the threaded inner shaft that is spaced apart from the first end of the first shaft such that a first distance is defined between the first end of the first shaft and the first pad, and a retention mechanism secured to the first shaft between the first end of the first shaft and the second shaft such that a second distance is defined between the pad and the retention mechanism, wherein the threaded inner shaft is rotatable relative to the first shaft to change the first distance defined between the first end of the first shaft and the pad and to change the second distance defined between the pad and the retention mechanism, wherein the retention mechanism includes a clip having a first arm that is moveable relative to a second arm, wherein (i) the first arm has a first tip spaced apart from the first shaft, and (ii) the second arm has a second tip spaced apart from the first shaft, wherein the second arm is fixed to the first shaft and positioned between the first arm and the first shaft and the first tip and the second tip point upwardly toward the pad, and wherein the retention mechanism is operable to move between (i) an engaged position in which the sheet is gripped between the first tip of the first arm and second tip of the second arm such that the sheet is secured to the telescopic rod, and (ii) a disengaged position in which the first tip is positioned away from the second tip and the sheet is detached from the telescopic rod.

* * * * *